US005456974A

United States Patent [19]

Lundblad et al.

[11] Patent Number: 5,456,974

[45] Date of Patent: Oct. 10, 1995

[54] BALLISTIC RESISTANT ARTICLE COMPRISING A THREE DIMENSIONAL INTERLOCKING WOVEN FABRIC

[76] Inventors: Wayne E. Lundblad, 819 Woodmere, Vestavia, Ala. 35226; Carl Dixon, 401 W. Crest Estates, Hueytown, Ala. 35023; Harold C. Ohler, 1528 NE. 99th St., Kansas City, Mo. 64155

[21] Appl. No.: 202,539

[22] Filed: Feb. 28, 1994

Related U.S. Application Data

[63] Continuation-in-part of Ser. No. 31,389, Mar. 12, 1993, abandoned.

[51] Int. Cl.[6] ..... D03D 11/00; D03D 15/00; B32B 7/00; D04B 1/00

[52] U.S. Cl. ..... 428/229; 139/408; 428/257; 428/258; 428/259; 428/902; 428/911

[58] Field of Search ..... 139/408; 428/257, 428/258, 259, 911, 229, 902

[56] References Cited

U.S. PATENT DOCUMENTS

| | | | |
|---|---|---|---|
| 2,899,987 | 8/1959 | Finken et al. | 428/911 |
| 4,379,798 | 4/1983 | Palmer et al. | 428/113 |
| 4,983,433 | 1/1991 | Shirasaki | 428/36.1 |
| 5,104,726 | 4/1992 | Ross | 428/246 |

*Primary Examiner*—James D. Withers
*Attorney, Agent, or Firm*—Pollock, Vande Sande & Priddy

[57] ABSTRACT

An article of manufacture that contains a plurality of yarns woven into an interlocking 3-dimensional structure whether or not uniform and symmetrical such that the interlocking impedes the penetration of projectiles such as bullets, fragments, flachettes and the like. The articles of the present invention are useful for providing a high degree of ballistic resistance and are therefore useful in armor applications.

23 Claims, 8 Drawing Sheets

BALLISTIC RESISTANT ARTICLE COMPRISING A THREE DIMENSIONAL INTERLOCKING WOVEN FABRIC

CROSS-REFERENCE TO RELATED APPLICATION

This is a continuation-in-part of our U.S. patent application Ser. No. 08/031,389, filed Mar. 12, 1993, and entitled "Ballistic Resistant Article", now abandoned.

TECHNICAL FIELD

The present invention is concerned with an article that exhibits a relatively high degree of ballistic resistance. The articles of the present invention are especially suitable for providing relatively lightweight ballistic resistant materials of decreased thickness. In particular, the present invention is concerned with certain woven materials that exhibit a 3-dimensional weave configuration. The articles of the present invention can be used in providing personal body armor, as well as armor for various structures, including vehicles, such as automobiles, planes, helicopters, satellites and especially military vehicles.

BACKGROUND ART

In order to protect military and law enforcement personnel from the hazards of projectiles, protective articles of clothing, such as vests, shirts and caps are provided. The typical ballistic resistant woven materials presently employed involve a 2-dimensional weave as shown in FIG. 1. In this type of weave, yarns are woven at right angles to one another in directions referred to as warp and weft or fill. The woven material is typically a high modulus material such as fibers of aramid, glass, quartz, polyolefins, such as polypropylene and polyethylene, and various polyesters. In addition, certain liquid crystal polymers such as polybenzothiozole and polybenzoxizole have been suggested for such purposes. Spider silk has also been considered by some sources.

The current 2-dimensional weaves are approximately 0.05 inches to about 0.08 inches thick and ballistic resistance is achieved by stacking together as many as thirty layers. The multi-layer panels are usually about 12 inches wide by 12 inches long and can range up to any thickness, depending upon the level of protection desired. For instance, a typical thickness for a class 2A protection (9 mm hand gun) is about 0.5 inches. The ballistic panels are then placed in strategic pockets in vests or jackets or similar articles of clothing to form body armor.

A disadvantage of the presently employed 2-dimensional weave configuration is that an impinging projectile tends to separate the warp and fill yarns as illustrated in FIG. 2. FIG. 2 illustrates the usual situation where the projectile separates the warp and fill yarns before being stopped at some intermediate layer. The separation caused by an impinging projectile makes it necessary to stack together several layers of the woven material in order to provide any degree of ballistic resistance. Of course, the more layers required, the heavier and less comfortable will be the particular piece of armor. Accordingly, continuing efforts are being made to provide fabrics exhibiting relatively light weight, while at the same time, exhibiting the desired degree of protection. Usually however, comfort is sacrificed for adequate performance. Balancing performance and comfort without a prohibitively expensive product is a major problem that challenges those involved in the design of soft body armor.

SUMMARY OF THE INVENTION

The present invention provides an article possessing improved ballistic resistance, while at the same time, being thinner than presently available articles exhibiting similar ballistic resistance. This in turn, makes it possible to provide relatively low weight ballistic resistant materials that nonetheless exhibit satisfactory resistance.

In particular, the advantages achieved by the present invention are obtained by employing any suitable 3-dimensional weave configuration. The configuration of the present invention is such that the yarns impede the penetration of an impinging projectile to a far greater extent than that experienced in conventional 2-dimensional weave configurations of the prior art.

More particularly, the present invention is concerned with an article of manufacture that contains a plurality of yarns in the warp direction (FIG. 7). The number of warp yarns of which determine the width and thickness of the final article (FIG. 3). The thickness of the article is comprised of at least two planes of high modulus warp yarns. More than two planes of warp yarns constitutes construction of said article of various thicknesses. In the fill direction a yarn is woven such to bind together any plurality of warp yarns, the number of which are bound together to determine the desired thickness and construction of the article. In addition, a second fill yarn, located behind the first fill yarn, is shifted over some specified increment in the width direction to bind together another plurality of warp yarns. A third fill yarn, located behind the second fill yarn, is further incremently shifted over in the width direction and ties together another plurality of warp yarns. This shifting arrangement of yarns is continued throughout substantially the entire width of the warp direction thereby providing an interlocked article.

BEST AND VARIOUS MODES FOR CARRYING OUT THE INVENTION

Figure 1:
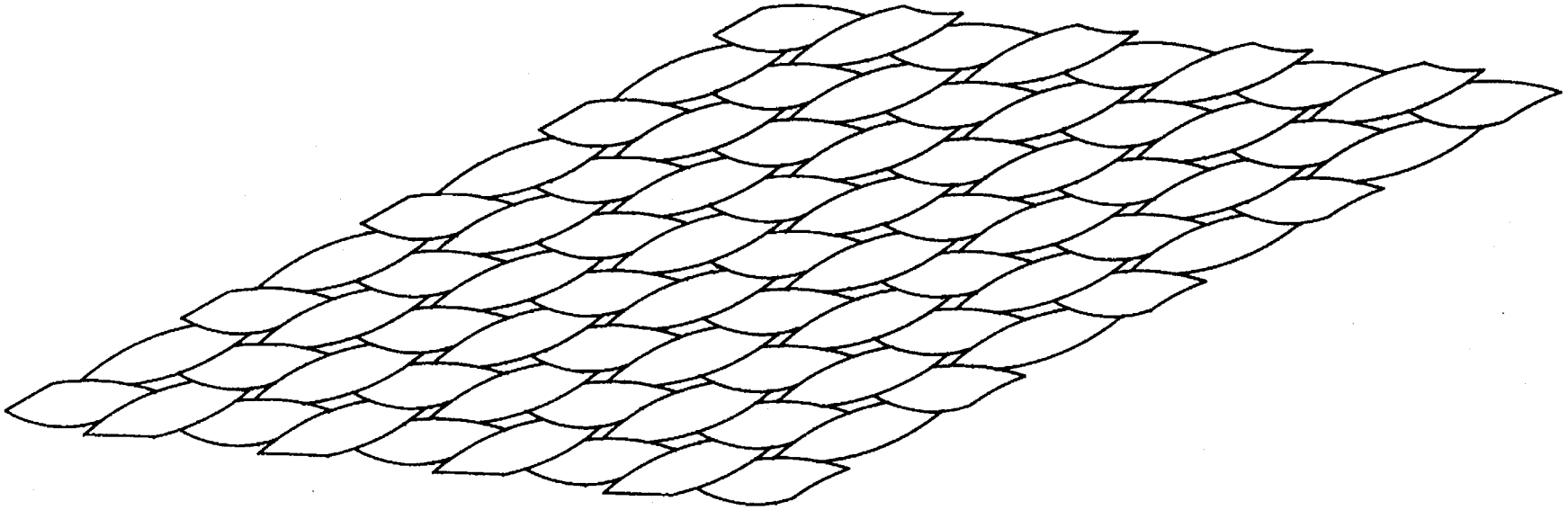
FIG. 1 illustrates a conventional prior art 2-dimensional weave.
Figure 2:
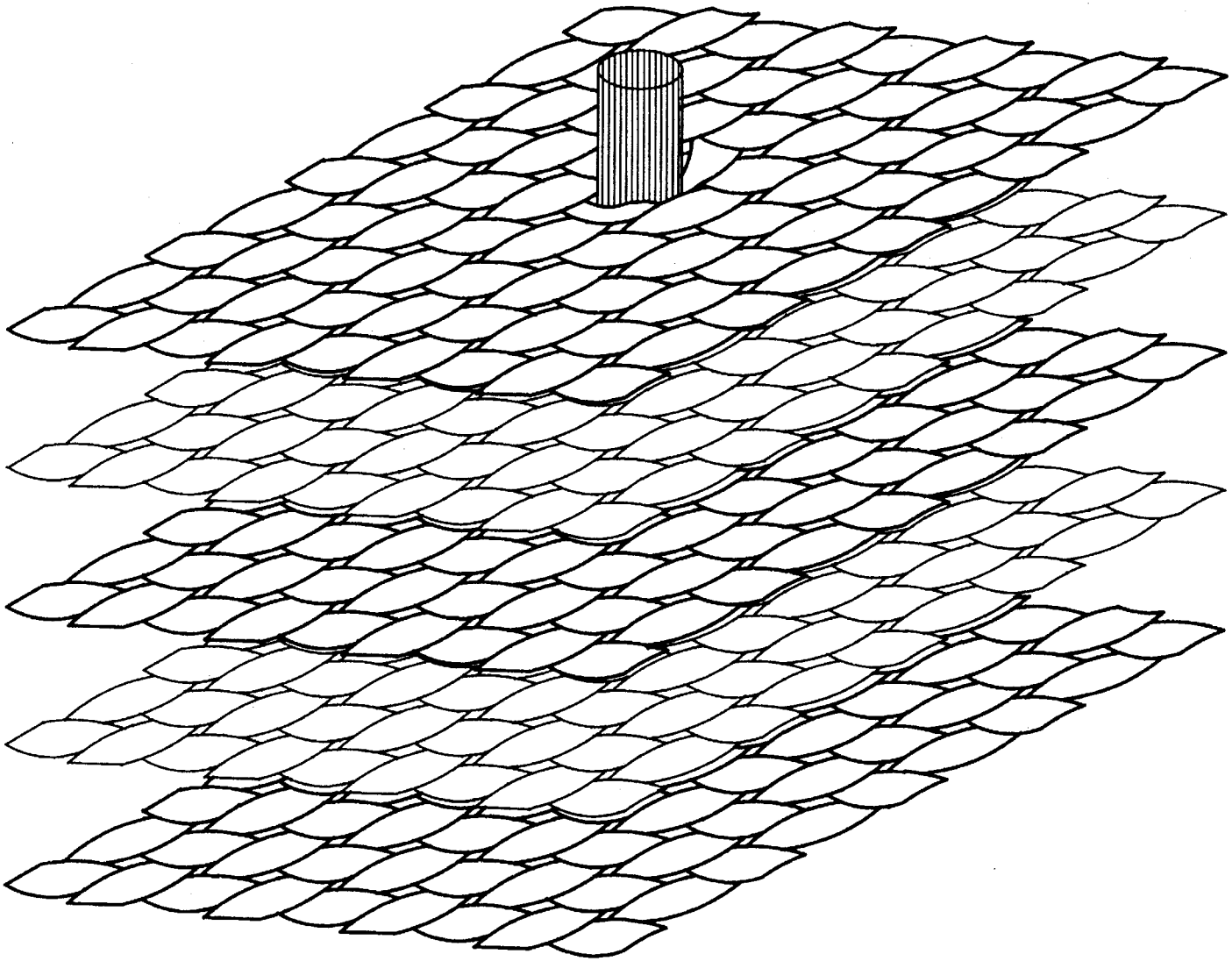
FIG. 2 illustrates the effect of an impinging projectile on a typical prior art 2-dimensional weave.
Figure 3:
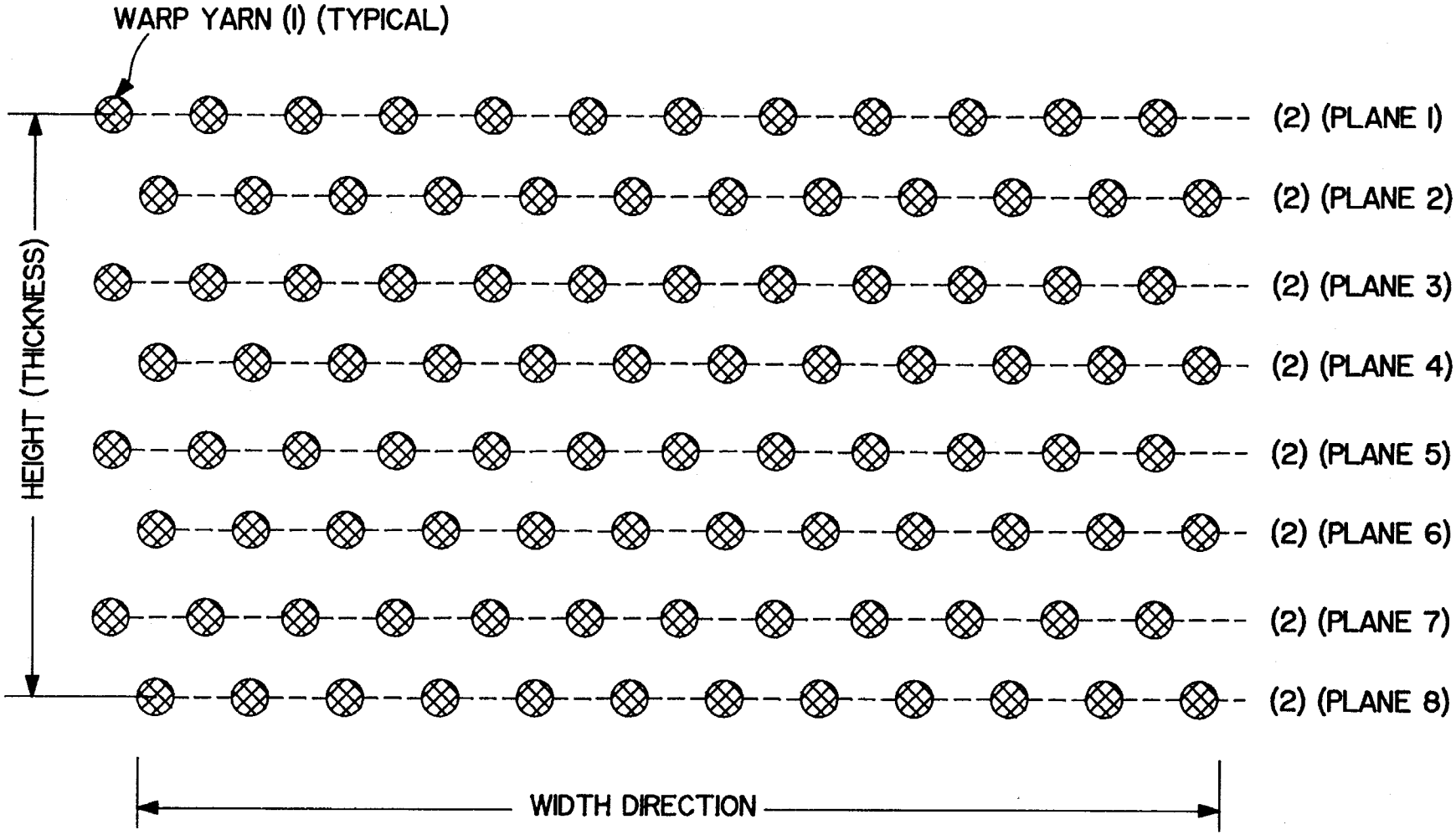
FIG. 3 is a schematic diagram of a eight plane warp yarn article.

In order to facilitate an understanding of the present invention, reference is made to FIGS. 3 through 7, which schematically illustrate a particular weave required by the present invention. In particular, FIG. 3 shows a plurality of high modulus warp yarns (1), arranged as to comprise eight planes (2). The yarns (1), to facilitate an understanding of the present invention, are illustrated as being spaced apart but when woven, will be touching each other. Although FIG. 3 illustrates an article comprising eight planes of warp yarns, the article can contain as few as two planes of warp yarns. The maximum number of warp planes is merely dictated by practical considerations, especially by the desired ballistic resistance for the particular article. The article contains a minimum of 2 planes of warp yarns, it can contain as many as desired for a required thickness but a preferable number is about 4–8 planes.

Figure 4:
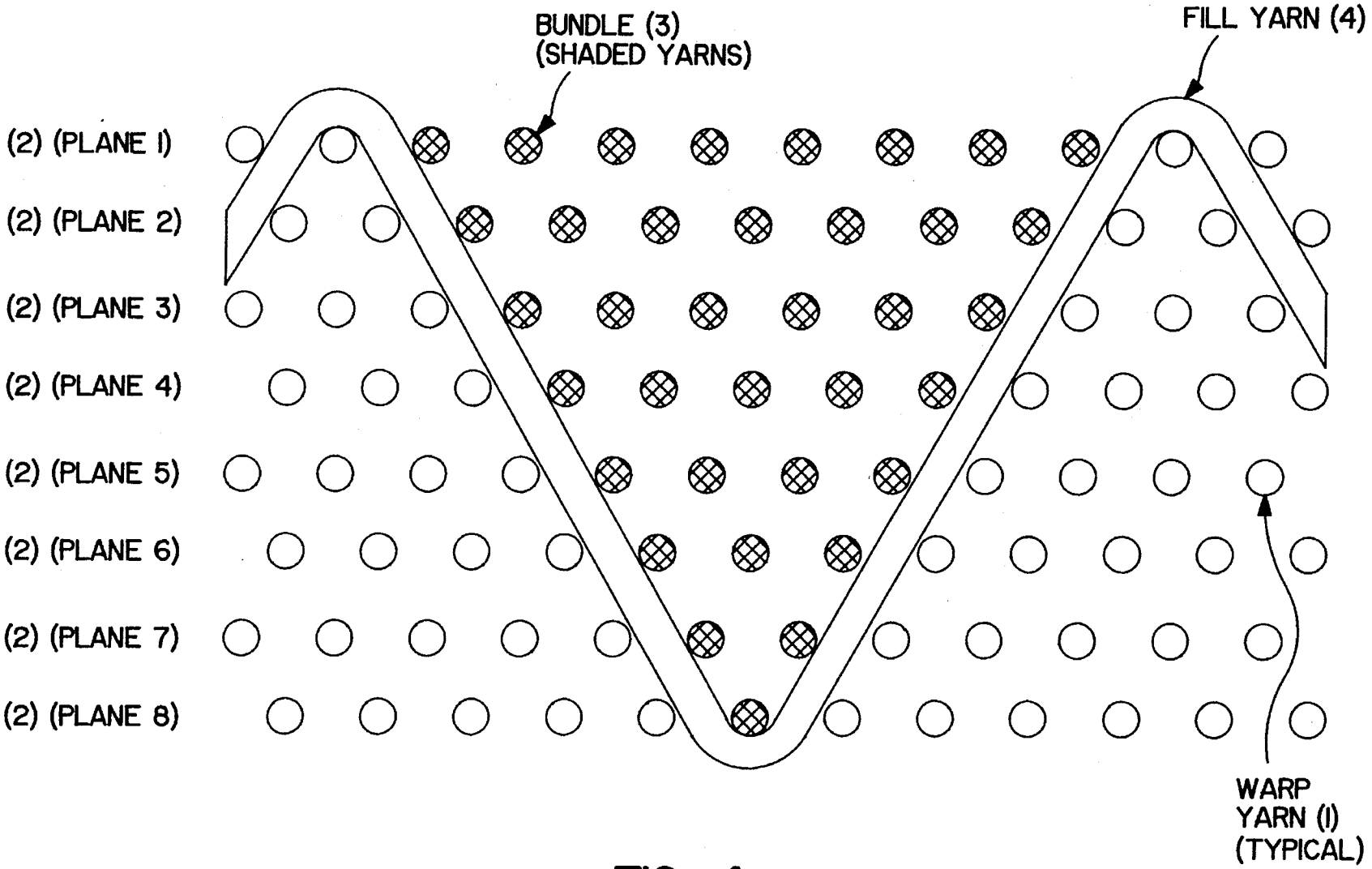
FIGS. 4 is a schematic diagram of an eight plane warp yarn article with a fill yarn.

In addition, as illustrated in FIG. 4, a fill yarn is used to tie together a plurality of warp yarns, referred to as a bundle (3). Each bundle (3) typically contains at least 3 warp yarns. The maximum number of warp yarns per bundle is merely dictated by practical considerations. FIG. 4 illustrates a bundle of 36 warp yarns. The high modulus fill yarns (4) can be any of the materials discussed previously that are employed for the high modulus warp yarns (1). According to preferred embodiments, the fill yarns (4) will be the same material as employed for the warp yarns (1), but do not have to be necessarily so.

Figure 5:
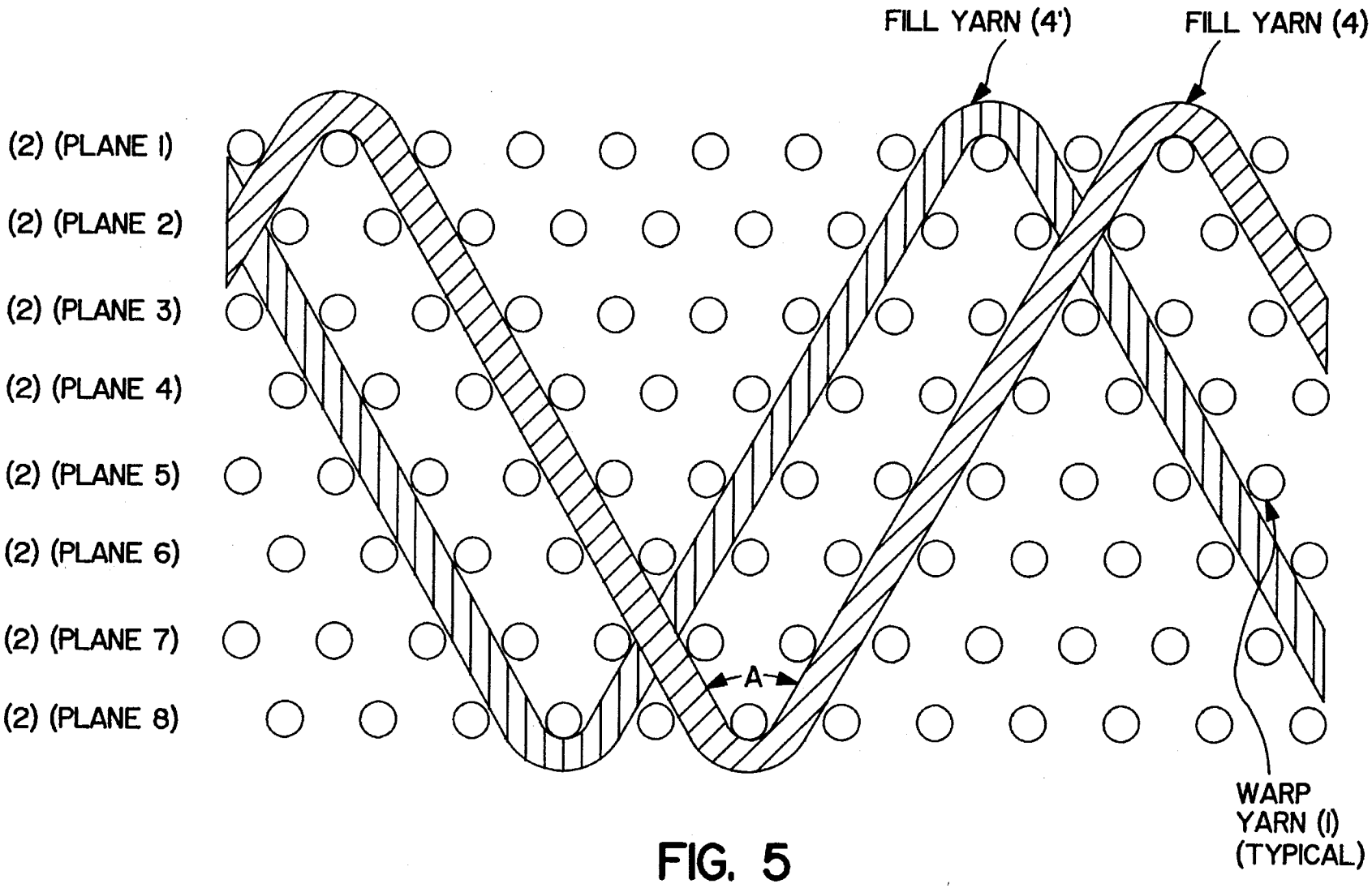
FIG. 5 is a schematic diagram of an eight plane warp yarn article with two fill yarns.

FIG. 5 illustrates a second fill yarn (4') woven directly behind the first fill yarn (4) but shifted over by one warp yarn in plane 1 in the width direction. The second fill yarn (4') also ties together a bundle of 36 warp yarns. The angle (A) of fill yarns is dependent on the bundle size and is typically about 30 to about 120 degrees and, according to preferred aspects of the present invention is about 45 to about 75 degrees, and most preferably about 60 degrees. Of course, if desired, angle (A) need not be the same throughout the article, but can vary.

Figure 6:
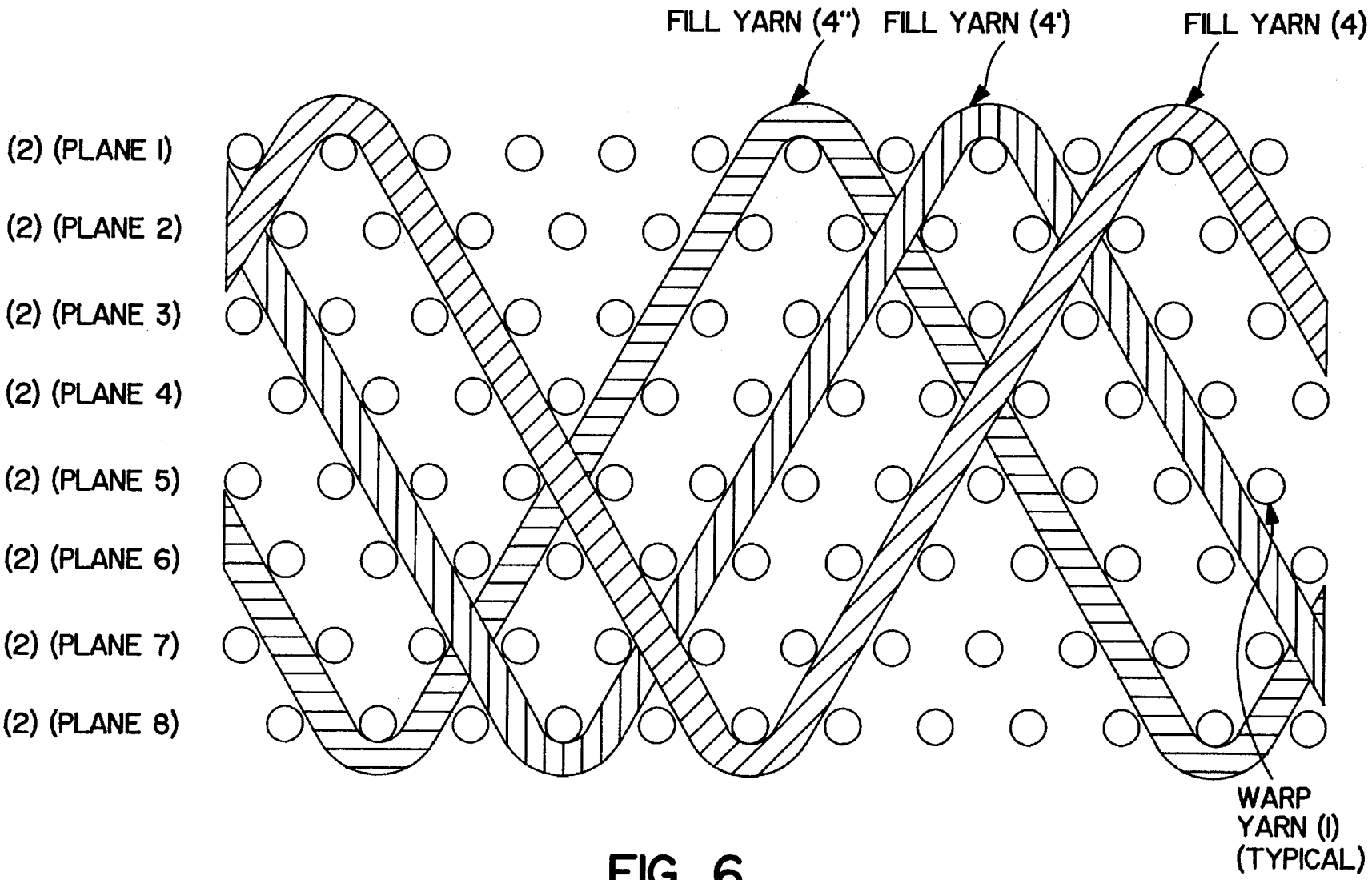
FIG. 6 is a schematic diagram of an eight plane warp yarn article with three fill yarns.

FIG. 6 illustrates a third fill yard (4") woven directly behind the second fill yarn (4') but again shifted over by one warp yarn in plane 1 with respect to yarn (4') and two warp yarns in plane 1 with respect to yarn (4). The third fill yarn (4") also ties together 36 warp yarns. This shifting arrangement of yarns continues throughout substantially the entire defined width of the article as illustrated in FIG. 7.

Figure 7:
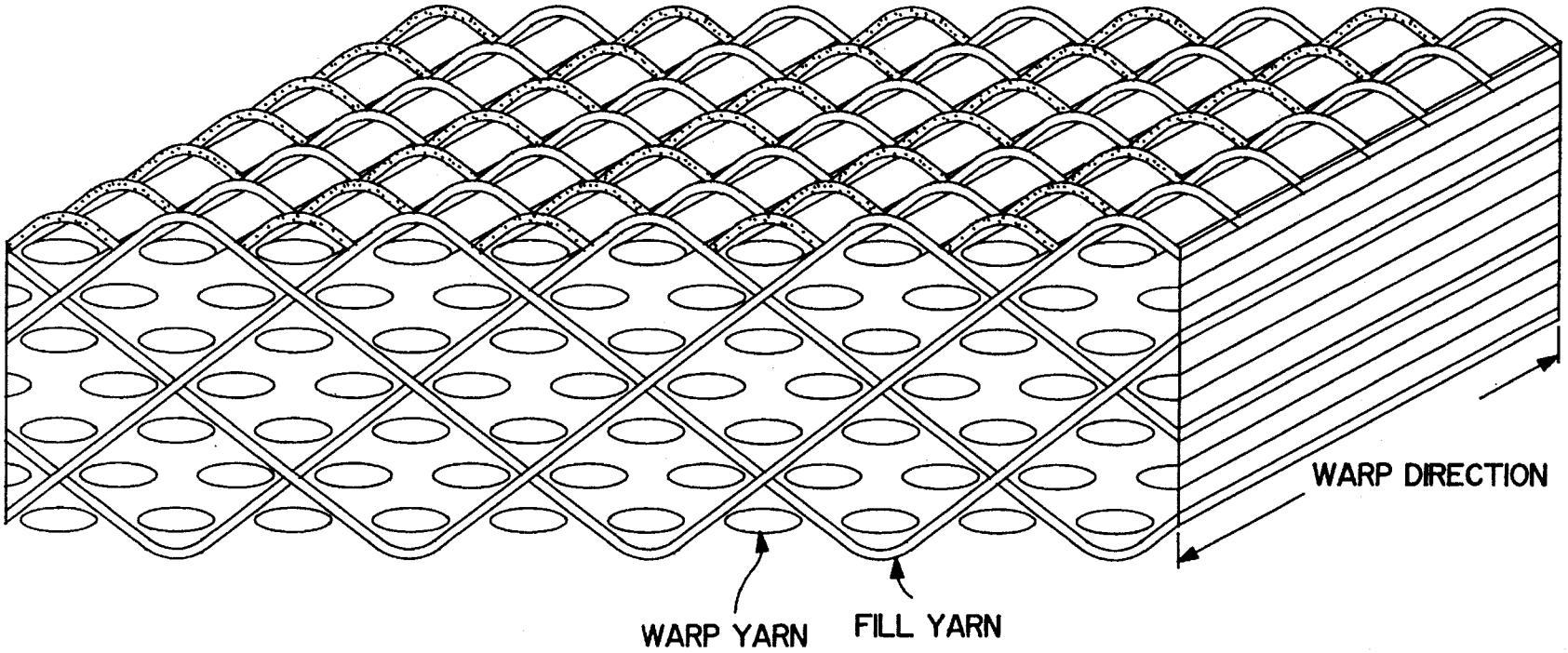
FIG. 7 is a 3-dimensional schematic diagram of an eight plane warp yarn complete article.

In addition, as shown in FIGS. 3–7, according to preferred aspects of the invention, the warp yarns in plane 2 are offset from the yarns in both plane 1 and plane 3 by one yarn to the right in the width direction. The yarns in planes 1 and 3 are aligned with each other, as are the warp yarns in planes 5 and 7; whereas the warp yarns in planes 4, 6 and 8 are aligned with those in plane 2, but offset from the warp yarns in the odd numbered planes. This offset arrangement continues throughout substantially the entire defined height of the article, as illustrated in FIGS. 3–7. However, if desired, but less preferred, the warp yarns in one plane can be offset by more than one yarn from the warp yarns in an adjacent plane. Moreover, it is not necessary that each warp yarn plane be offset from each of its adjacent warp yarn planes. It has been found, however, that the preferred offset arrangement, as illustrated in FIGS. 3–7, provide the highest yarn packing configuration, which in turn, provides for the most effective results for stopping an impinging projectile, fragment, flechette or the like. FIGS. 5–7 also illustrate the most preferred angle A of about 60 degrees.

This shifting arrangement along with the angled relationship of the yarns in the fill direction provide for the interlocking of the bundles which is critical to achieving the desired results obtained by the present invention. Additionally, all yarns are typically in contact with corresponding adjacent yarns.

The yarns employed are usually high elastic modulus yarns typically exhibiting a modulus of elasticity of at least about $10^4$ MPa (megapascals) and more typically at least about $10^5$ MPa.

Examples of some typical high modulus yarns that can be employed pursuant to the present invention are aramid, glass fibers such as E-glass fibers and quartz, polyolefins such as polyethylene and polypropylene, polyesters, nylon, liquid crystal polymers such as polybenzothiozole and polybenzoxizole, and silk. Of course, fiber blends can be used, if desired.

In addition, yarns in the warp direction and/or yarns in the fill direction can all be of the same material or can be of two or more different materials in any arrangement. For example, certain yarns in the warp direction could be of one type of material, while the other yarn in the warp direction could be of another material. It is preferred that the article obtained be flexible.

The article typically at the end where the weaving is begun contains the various yarns in the warp and fill directions being looped around each other to maintain the integrity of the article. In addition, cut ends of the article can be fused together by heat and/or sealed off with epoxies or rubber cement to prevent fraying of the yarns. Such techniques are well known in the art and need not be described herein in any great detail. Of course, at the ends of the article, as would be apparent to those skilled in the art, the configuration would typically deviate somewhat in the number of warp yarns per bundle from that shown for the remainder of the article, due to the needed ending technique employed.

The articles of the present invention can be constructed of two or more planes of warp yarns depending upon the desired ballistic resistance to be achieved by the particular article. For instance, the present invention employing a single thickness of the article can be used to replace a typical body armor employing about 25 layers of a 2-dimensional woven high modulus yarn, such as aramid (e.g. kevlar), to achieve the same or greater resistance and being significantly thinner than the combined 25 layers that would be employed in the prior art. In fact, a single thickness of the high modulus yarns, woven pursuant to the present invention, may provide class 3 protection (high powered rifles).

An important advantage of the present invention is that the particular weave exemplifies a weave configuration that precludes the yarns from being pushed apart by an impinging projectile and therefore, such is effectively stopped by the article. Along these lines, see FIGS. 8 and 9 that illustrate the effectiveness of the present invention. This type of weave is more effective in stopping polymer coated projectiles than prior art 2-dimensional weaves.

Figure 8:
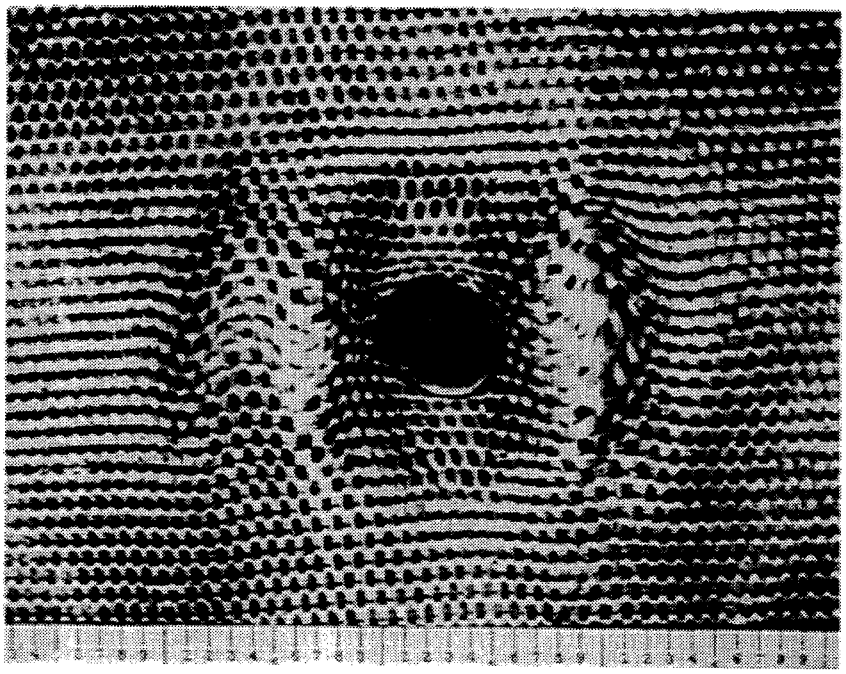
FIGS. 8 and 9 illustrate the results of testing performed on an article of the present invention.
Figure 9:
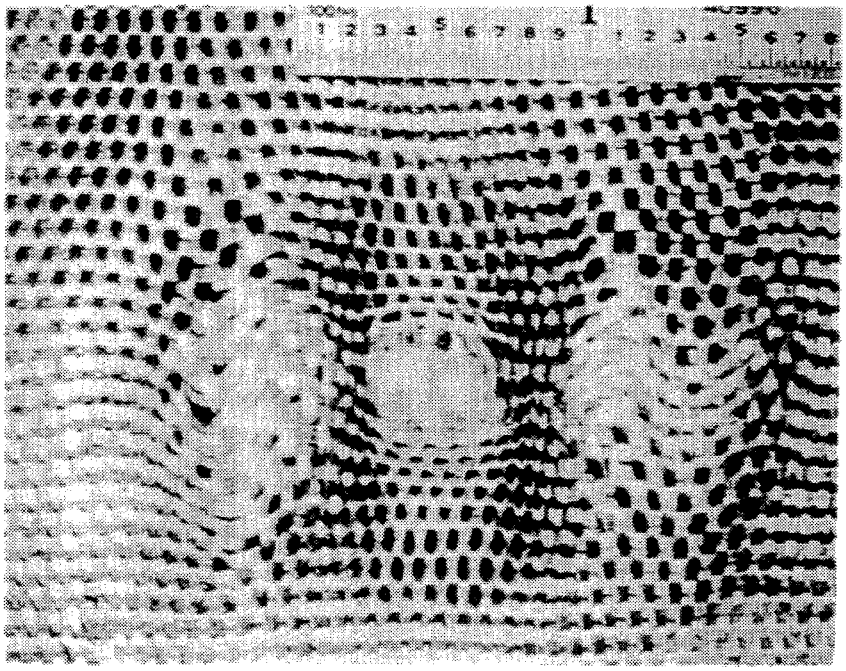

In particular, FIGS. 8 and 9 show the results of a test performed on a article made of aramide (kevlar 29 having a modulus of at least about $1.5\times10^5$ MPa) yarn about 0.25 inches thick, having the interlock configuration pursuant to the present invention, wherein the thickness is 8 planes of warp yarns. The denier of the Kevlar 29 is about 3000. However, the deniers can be significantly higher or lower, depending upon the yarn chosen. In the test, three samples of the article were placed in cardboard boxes and backed by sand. The samples were shot by a 0.38 special revolver loaded with full metal jacket, 158 grain bullets from a distance of 15 feet. As shown in FIG. 8, the bullet was effectively stopped by the article. FIG. 9 shows that the bullet did not separate any of the yarns, thereby illustrating the advantages achieved by the present invention.

In use, the article can be employed for any lightweight armor application. In particular, the articles can be employed in preparing personal soft body armor, as well as armor for stationery and mobile objects, such as military vehicles, automobiles, planes, helicopters and satellites. When used for more typical soft body armor, such as vests, the articles of the present invention would be placed within particular strategic pockets in a vest or a jacket, as conventionally done with the prior art ballistic resistant woven materials. The articles of the present invention can be fabricated by standard industrial type looms.

Various configuration that can employ the articles of the present invention are illustrated in the publication "body armor" by Safariland, May 1992, disclosure of which is incorporated herein by reference.

What is claimed is:

1. A three dimensional interlocking woven article of manufacture exhibiting resistance to impinging projectiles comprising at least two planes containing a plurality of yarns in a warp direction; located in the fill direction is a first fill yarn that is woven such to bind together a plurality of warp yarns in all of said at least two planes; a second fill yarn having the same weave pattern as the first fill yarn located directly behind said first fill yarn and shifted over a specific increment of warp yarns in the fill direction to bind together the same number of warp yarns as bounded by the first fill yarn; a third fill yarn having the same weave pattern as the first and second fill yarn located directly behind said second fill yarn and shifted over a specific increment of warp yarns in the fill direction to bind together the same number of warp yarns as bounded by the first and second fill yarns; wherein this weave pattern and shifting arrangement of yarns is continued throughout substantially the entire fabric thereby providing an interlocked three dimensional article; and wherein the angle created by the change in direction of any individual fill yarn is about 45 to about 75 degrees.

2. The article of manufacture of claim 1 wherein said angle is about 60 degrees.

3. The article of manufacture of claim 1 where the yarns in all directions are of the same material.

4. The article of manufacture of claim 1 wherein the yarns in the warp direction is of a different material than the yarn in the fill direction.

5. The article of manufacture of claim 1 wherein the yarns in each direction are individually selected from the group consisting of aramid, glass, quartz, polyolefins, polyesters, nylon, polybenzothiozole, polybenzoxizole, silk and mixtures thereof.

6. The article of manufacture of claim 1 wherein the yarns in each direction are of aramid.

7. The article of manufacture of claim 1 being in the form of armor.

8. The article of manufacture of claim 1 wherein yarns in the warp direction or the fill direction or both are of different material.

9. A three dimensional interlocking woven article of manufacture exhibiting resistance to impinging projectiles comprising at least two parallel planes containing a plurality of yarns in a warp direction; located in the fill direction is a first fill yarn that is woven such to bind together a plurality of warp yarns in all of said at least two planes; a second fill yarn having the same weave pattern as the first fill yarn located directly behind said first fill yarn and shifted over a specific increment of warp yarns in the fill direction to bind together the same number of warp yarns as bounded by the first fill yarn; a third fill yarn having the same weave pattern as the first and second fill yarn located directly behind said second fill yarn and shifted over a specific increment of warp yarns in the fill direction to bind together the same number of warp yarns as bounded by the first and second fill yarns; wherein this weave pattern and shifting arrangement of yarns is continued throughout substantially the entire fabric thereby providing an interlocked three dimensional article; and wherein the angle created by the change in direction of any individual fill yarn is about 45 to about 75 degrees.

10. The article of manufacture of claim 9 wherein the article contains as many planes of warp yarns as required for a desired thickness.

11. The article of manufacture of claim 9 wherein the article contains four to eight planes of warp yarns.

12. The article of manufacture of claim 11 wherein the warp yarns in one warp plane are offset from the warp yarns in the planes adjacent thereto by one yarn in the width direction, and wherein the planes adjacent to said one warp plane are aligned with each other.

13. The article of manufacture of claim 9 wherein the yarns in all directions are of the same material.

14. The article of manufacture of claim 9 wherein the yarn in the warp direction is of a different material than the yarn in the fill direction.

15. The article of manufacture of claim 9 wherein said angle is about 60 degrees.

16. The article of manufacture of claim 9 wherein the yarns in each direction are individually selected from the group consisting of aramid, glass, quartz, polyolefins, polyesters, nylon, polybenzothiozole, polybenzoxizole, silk and mixtures thereof.

17. The article of manufacture of claim 9 wherein the yarns in each direction are of aramid.

18. The article of manufacture of claim 17 being in the form of personal body armor.

19. The article of manufacture of claim 17 being in the form of armor for vehicles, planes and satellites.

20. The article of manufacture of claim 9 being in the form of armor.

21. The article of manufacture of claim 19 being in the form of personal body armor.

22. The article of manufacture of claim 19 being in the form of armor for vehicles, planes and satellites.

23. The article of manufacture of claim 9 wherein yarns in the warp direction or the fill direction or both are of different material.

* * * * *